US007554499B2

(12) United States Patent
Munk et al.

(10) Patent No.: US 7,554,499 B2
(45) Date of Patent: Jun. 30, 2009

(54) RADOME WITH DETUNED ELEMENTS AND CONTINUOUS WIRES

(75) Inventors: Benedikt A. Munk, Columbus, OH (US); Heriberto J. Delgado, Melbourne, FL (US); Robert Taylor, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 507 days.

(21) Appl. No.: 11/411,313

(22) Filed: Apr. 26, 2006

(65) Prior Publication Data

US 2007/0252775 A1 Nov. 1, 2007

(51) Int. Cl.
*H01Q 1/02* (2006.01)
*H01Q 1/42* (2006.01)

(52) U.S. Cl. ..... 343/704; 343/872

(58) Field of Classification Search ..... 343/704
See application file for complete search history.

(56) References Cited

U.S. PATENT DOCUMENTS 3,789,404 A * 1/1974 Munk ..... 342/5
4,203,105 A 5/1980 Dragone et al.
4,479,129 A 10/1984 Skahill et al.
4,755,826 A 7/1988 Rao et al.
4,999,639 A 3/1991 Frazita et al.
5,528,249 A 6/1996 Gafford et al.
5,659,324 A * 8/1997 Taniguchi et al. ..... 343/713
6,236,375 B1 5/2001 Chandler et al.
6,330,986 B1 * 12/2001 Rutherford et al. ..... 244/134 E
6,995,725 B1 * 2/2006 Honda et al. ..... 343/771
2003/0052810 A1 * 3/2003 Artis et al. ..... 342/1
2004/0008148 A1 1/2004 Lyerly et al.

FOREIGN PATENT DOCUMENTS

JP 10 065438 6/1998

* cited by examiner

*Primary Examiner*—Trinh V Dinh
(74) *Attorney, Agent, or Firm*—Darby & Darby PC; Robert J. Sacco

(57) ABSTRACT

A radome uses traditional continuous heating wires mixed with detuned dipoles between heating wires and can be placed at any chosen distance from an array antenna or FSS. The continuous heating wires add a reactive component to the incident field phase, which is effectively cancelled out by the detuned dipoles which provide a capacitive component. The orthogonal components of the incident field are transmitted with very small losses over a wide number of scan angles. These heating and detuned dipoles can be printed on low loss dielectric materials. In addition, the printed elements of this radome can be scaled to operate over a chosen frequency band.

23 Claims, 9 Drawing Sheets

RADOME WITH DETUNED ELEMENTS AND CONTINUOUS WIRES

STATEMENT REGARDING FEDERALLY SPONSORED RESEARCH OR DEVELOPMENT

This invention was made with government support under Contract No. N00024-02-C-2302. The government has certain rights in the invention.

BACKGROUND OF THE INVENTION

1. Statement of the Technical Field

The inventive arrangements relate to radomes, and more particularly to environmental protection systems for radome.

2. Description of the Related Art

Radomes are designed to protect enclosed electromagnetic devices, such as antennas, from environmental conditions such as wind, lightning, solar loading, ice, and snow. Conventional radome types include sandwich, space frame, solid laminate, and air supported. Radome induced wave perturbations are a principal consideration in radome construction. An ideal broad band radome is electromagnetically transparent to a large or selected number of radio frequencies, through a wide range of incident angles. However, in practice, conventional radomes are inherently lossy and are narrowbanded.

The walls of conventional radomes are formed from dielectric materials. Conventional teachings suggest that metals are generally to be avoided in radomes unless required by overriding environmental, electrical or structural considerations. For example, excessive ice buildup on a radome can cause poor performance and, in extreme cases, structural failure. Ice buildup can be prevented by the presence of heating wires disposed within the radome for preventing ice buildup. U.S. Pat. Nos. 4,999,639 and 5,528,249 each disclose the use of such heating wires in radomes. Similarly, metal wires incorporated in radome systems can be used as part of an effective lighting protection system. Finally, embedded metal wires can also be used as part of a grounding system to reduce static buildup on the dielectric surfaces of the radome.

Still, there are problems that arise from embedding wires within a radome. For example, current RF performance of radomes equipped with de-icing wires tends to be relatively poor. This poor performance also extends to radomes that use embedded wires for lightning and anti-static protection. The embedded wires act as polarizers and otherwise interfere with RF transmissions passing through the radome. In order to avoid such undesirable effects, it has been suggested in U.S. Pat. No. 5,528,249 that radome wires can be shielded from RF energy by strategically positioning the heating wires in selected areas of a frequency selective surface (FSS). However, the wires tend to degrade FSS electrical performance. These kinds of systems also require tight manufacturing tolerances since heating wires must not cross through certain portions of the FSS elements. Further, this arrangement is impractical for FSS designs that use triangular lattices since the wires, which are generally aligned in straight lines, will necessarily have to follow zigzag paths in order to avoid crossing over undesirable areas of the FSS elements, thereby degrading their performance. Finally, it will be appreciated that FSS scan angle stabilization cannot be effectively achieved with this approach since it requires adding a relatively thick dielectric layer between the heating wire surface and the exterior environment. This limitation is due to the proximity of the FSS surface to the heating wire surface.

Despite their drawbacks, embedded wire systems continue to be used in radomes for de-icing, lightning protection, and anti-static protection because such protection systems are essential in a variety of applications. Accordingly, there is a need for an improved protection system for radomes.

SUMMARY OF THE INVENTION

The invention concerns a radome that is at least partially formed of a dielectric substrate. Two or more conductive heating wires are disposed in or on the substrate. The conductive heating wires can be used for preventing ice buildup on the exterior of the radome during inclement weather. For example, an electric current can be caused to flow along a continuous length of one or more of the conductive heating wires to heat the radome. The conductive heating wires can also provide a degree of lightning protection for the radome and can reduce the buildup of static electricity. In this regard, the heating wires can be connected to a ground of a vehicle on which the radome is mounted.

The conductive heating wires have an inductive reactance that can negatively interfere with the RF performance of the radome. In order to counteract this negative effect, capacitive elements having a capacitive reactance can be interspersed or distributed among the heating wires. The capacitive elements can be designed to have a resonant frequency that is distinct from a designed operating frequency band of the radome. According to one aspect of the invention, the capacitive elements can have a capacitive reactance that at least partially cancels out an inductive reactance of the heating wires. According to another aspect of the invention, the capacitive elements can be dipoles.

The capacitive elements can be positioned between adjacent heating wires. Further, if the capacitive elements are dipoles, then an elongated length of the dipoles can be aligned with an elongated length of the heating wires. For the purposes of manufacturing convenience, the heating wires and/or the capacitive elements can be printed on the dielectric substrate forming the radome. The dielectric substrate can be formed of any suitable material. For example, the dielectric substrate can be a polyimide material disposed over a reinforced thermoset material. Examples of reinforced thermoset materials can include Polyester/"E" Fiberglass, Epoxy/"E" Fiberglass, Epoxy/Quartz, Cyanate Ester/Quartz, Bismaleimide/Quartz, Polyimide/"E" Fiberglass, and Polyimide/Quartz.

The invention also concerns a method for improving RF performance of a radome that includes a plurality of conductive heating wires. The method can begin by determining an inductive reactance of the heating wire. Two or more capacitive elements can be interspersed among the heating wires. The capacitive elements can be advantageously selected to produce a radome anti-resonant frequency. The anti-resonant frequency can be a frequency of maximum cancellation of the inductive reactance. The anti-resonant frequency can be selected to adjust a position of a pass band for the radome. For example, the anti-resonant frequency can be positioned within the pass band. Further, the plurality of capacitive elements can be sized and shaped to have a capacitive reactance that at least partially cancels out an inductive reactance of the heating wires. According to one embodiment, the capacitive elements can be dipoles.

According to one embodiment, the capacitive elements can be positioned between adjacent ones of the heating wires. Further, if the capacitive elements are dipoles, then an elongated length of the dipoles can be aligned with an elongated length of the heating wires. For convenience of manufacture, the wires and/or the capacitive elements can be printed on a dielectric substrate forming a part of the radome. For example, the dielectric substrate can be selected to include one or more layers of a polyimide material disposed over a reinforced thermoset material. Further, the heating wires can be electrically connected to a ground of a vehicle on which the radome is mounted to improve lighting protection and anti-static protection of the radome.

DETAILED DESCRIPTION OF THE PREFERRED EMBODIMENTS

Figure 1:
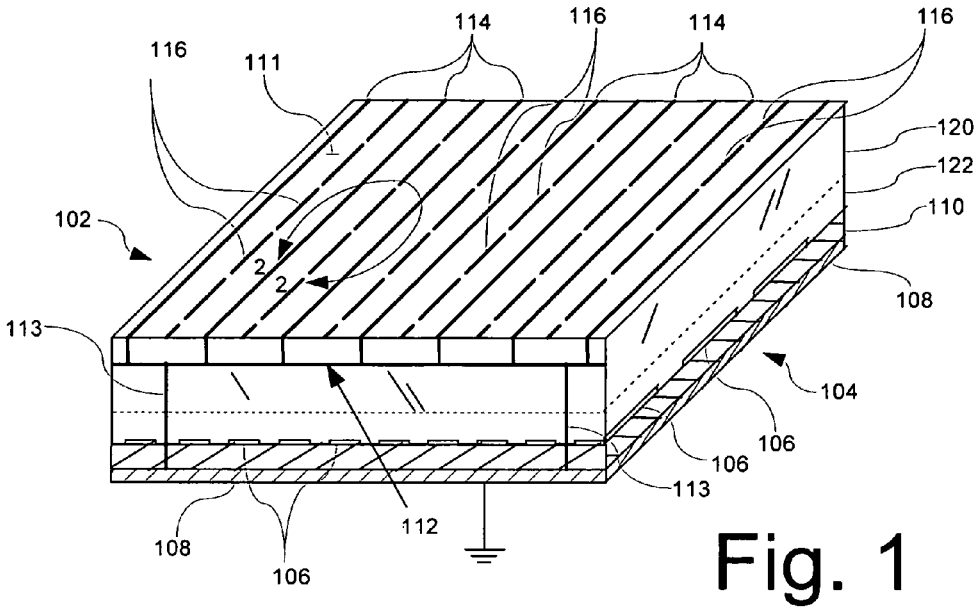
FIG. 1 is a perspective view showing a portion of a radome that is useful for understanding the invention.

FIG. 1 is a perspective view of a portion of a radome 102 that covers or encloses an antenna system 104. The radome 102 in FIG. 1 is shown generally adjacent to the antenna system 104 in FIG. 1. However, it should be understood that the invention is not limited in this regard. Other radome arrangements are also possible in which the radome is spaced to a greater degree from the antenna system 104. For example, the radome 102 can be part of a dome structure that is constructed around an antenna that comprises a rotatable array. A wide variety of radome structures are well known in the art and all such radome structures are intended to be included within the scope of the invention without limitation. Accordingly, it should be understood that the method and construction of a radome described herein can be used in any type of radome.

Referring again to FIG. 1, the radome 102 can be at least partially comprised of a dielectric substrate 120. The dielectric substrate 120 can be in physical contact with the antenna system 104 or it can be optionally separated from the antenna system by some distance. According to one embodiment, a second layer of dielectric substrate 122 can be disposed between the dielectric substrate 120 and the antenna system 104. For example, the second layer of dielectric material can be a solid dielectric, air or any other suitable dielectric material. The dielectric substrate 120 can be formed of any suitable material. For example, the dielectric substrate 120 can be a polyimide or polyester material and dielectric substrate 122 can be a reinforced thermoset material. Examples of suitable polyimide materials can include Kapton® polyimide film, which is commercially available from Sheldahl Technical Materials of Northfield, Minn. Examples of suitable polyester films that can be used include Mylar® which is also commercially available from Sheldahl Technical Materials of Northfield, Minn. Examples of reinforced thermoset materials can include Polyester/"E" Fiberglass, Epoxy/"E" Fiberglass, Epoxy/Quartz, Cyanate Ester/Quartz, Bismaleimide/Quartz, Polyimide/"E" Fiberglass, and Polyimide/Quartz.

The particular type of antenna system that is used with the present invention is not relevant. Accordingly, any suitable combination of one or more antenna elements 106 can be used. For example, the antenna system 104 can include an array of conductive antenna elements 106 that are disposed on an antenna substrate 110. The antenna substrate 110 can also include an optional conductive metal ground plane 108. Still, it should be understood that the antenna system and associated radome need not be planar. Instead, the radome can be arbitrarily shaped as needed to enclose large antennas, such as reflectors. In this regard, those skilled in the art will appreciate that the radome described herein can be used with any antenna, and it is not limited with regard to any particular arrangement of elements or material substrates.

Referring again to FIG. 1, it can be observed that two or more conductive heating wires 114 can be disposed on surface 111 of the dielectric substrate 120. The conductive heating wires 114 can also be disposed within the dielectric substrate 120 or between dielectric substrates 120 and 122. The conductive heating wires 114 can be formed of any one of a variety of metal or metal alloy materials that can generate a suitable heating effect when conducting an electric current. Such resistance wire materials are well known in the art. For example, it is well known that Nickel Chrome (NiCr) alloys can be used for this purpose. Other types of heating alloys that can be used for heating wires 114 include those formed from mixtures of Iron, Chromium and Aluminium (FeCrAl). Still, those skilled in the art will appreciate that the invention is not limited to any particular alloy or mixture of metals.

The conductive heating wires 114 can be used for preventing ice buildup on the exterior of the radome 102 during inclement weather. For example, an electric current can be caused to flow along a continuous length of one or more of the conductive heating wires 114 to heat the radome. The conductive heating wires 114 can also provide a degree of lightning protection for the radome and can reduce the buildup of static electricity. In this regard, the heating wires 114 can be connected to an earth ground or a ground of a vehicle on which the radome is mounted. For example, in FIG. 1, a conductive metal bus wire 112 can be used to connect one or more of the conductive heating wires 114 to grounding posts 113. The grounding posts 113 can extend from the radome to an electrical ground, such as ground plane 108. The ground plane can be connected to a system or vehicle ground on which the radome is mounted. An opposing end of each conductive heating wire 114 can be connected to a voltage source (not shown) for inducing a flow of electric current along a length of each conductive heating wire. The flow of electric current can be used to heat the radome.

In general, the conductive heating wires, will have an inductive reactance. This inductive reactance can be a problem with regard to RF energy that is transmitted through the radome. For example, the heating wires will act as a polarizer, increasing attenuation of RF signals for all polarizations at all angles.

According to an embodiment of the invention, the negative effects of heating wires in a radome can be counteracted to a substantial extent by means of a canceling effect to produce an anti-resonance in a desired radome passband. More particularly, the inductive reactance associated with the heating wires can be cancelled out to a substantial extent by selectively adding capacitive elements 116 to the radome 102. The capacitive elements can be placed on the surface 111 of the radome or can be disposed within the dielectric substrate. As used herein, the term capacitive element generally refers to any detuned element arranged in a periodic lattice forming part of a periodic surface that includes a plurality of such detuned elements closely spaced to one another so as to generate a capacitive response. In this regard, those skilled in the art will appreciate that there can be many different types of elements that can be separated from one another by a gap, such as the wide variety of elements that are used in frequency selective surfaces. Accordingly, the exact geometry, inter-element spacing, dimensions, quantity and/or distribution of the capacitive elements can be selected by the designer. Moreover, it will be appreciated that while a single column of capacitive elements is shown between pairs of heating wires, the invention is not limited in this regard. Multiple columns of capacitive elements 116 can be provided between adjacent pairs of heating wires 114 and can be desirable in some instances.

The foregoing design parameters associated with the capacitive elements can be selected so that the periodic array of capacitive elements will cancel out all or part of the inductive reactance associated with the heating wires 114 within each area of the radome through which RF energy is to be transmitted. It will be appreciated that each of the capacitive elements 116 can inherently also have some small amount of inductance, but the overall response is preferably dominated by the capacitive reactance. It can be desirable to minimize any inductive reactance associated with the capacitive elements.

The capacitive reactance of the periodic array of capacitive elements 116 can be selected to at least partially offset or cancel the inductive reactance of the heating wires 114. According to a further embodiment, the geometry, inter-element spacing, dimensions, quantity and/or distribution of the capacitive elements 116 can be selected so that the capacitive elements substantially entirely cancel the inductive reactance of the heating wires 114, at least within a predetermined range of frequencies at which the radome 102 is designed to operate. The frequency at which maximum cancellation of inductive reactance occurs is referred to herein as the radome anti-resonant frequency.

According to one embodiment, the capacitive elements 116 can be disposed between adjacent ones of the heating wires 114 as shown in FIG. 1. A single column of capacitive elements 116 is shown between adjacent pairs of heating wires 114, but the invention is not limited in this regard. Multiple columns of capacitive elements 116 are possible. Further, the capacitive elements 116 can be selected to have a resonant frequency that is distinct from a designed operating frequency band of the radome. However, the resonant frequency of the capacitive elements is not a critical design factor. Still, it will be understood by those skilled in the art that by ensuring the capacitive elements are detuned with respect to the designed operating frequency band of the radome, the capacitive elements are less likely to have any negative effect on the RF energy transmitted through the radome.

Figure 2:
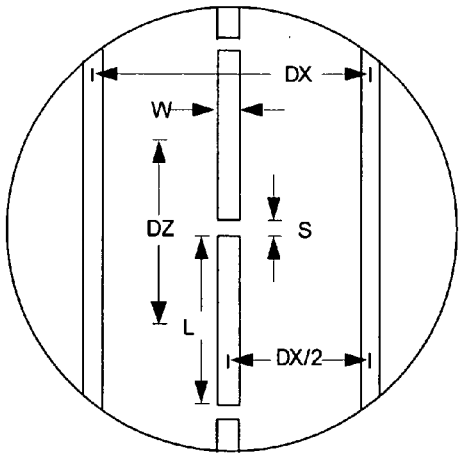
FIG. 2 is an enlarged view of a portion of the surface of the radome in FIG. 1.

Referring now to FIG. 2, the heating wires 114 and the capacitive elements 116 are shown in greater detail. As shown in FIG. 2, the capacitive elements 116 can be selected to be linear dipole elements. In that case, each of the capacitive elements 116 can be comprised of linear portions having opposing ends. Still, the invention is not limited in this regard, and any other suitable element geometry can be selected. Each of the capacitive elements 116 can have a length "L", a width "W", and the opposing ends of adjacent elements can be separated from one another by a gap "S". In FIG. 2, center to center spacing between elements arranged end to end is DZ. Elements are separated by a spacing DX. Element to heating wire spacing is DX/2.

One or more of the design parameters of the capacitive elements can be selected such that the capacitive elements 116 are detuned from the operational design frequency of operation of the radome. For example, the length and width of the capacitive elements 116 can be modified to change the resonant frequency. In general, the resonant frequency can be varied in response to changes in the parameters DZ, DX, W, and S. The resonant frequency can also be varied in response to changes in the thickness and dielectric constant of dielectric slabs above and below the printed structure. The geometry, inter-element spacing, dimensions, quantity and/or distribution of the capacitive elements 116 can be selected so that the capacitive elements partly or substantially entirely cancel the inductive reactance of the heating wires 114. For the purposes of manufacturing convenience, the heating wires and/or the dipoles can be printed on the dielectric substrate forming the radome.

Figure 3:
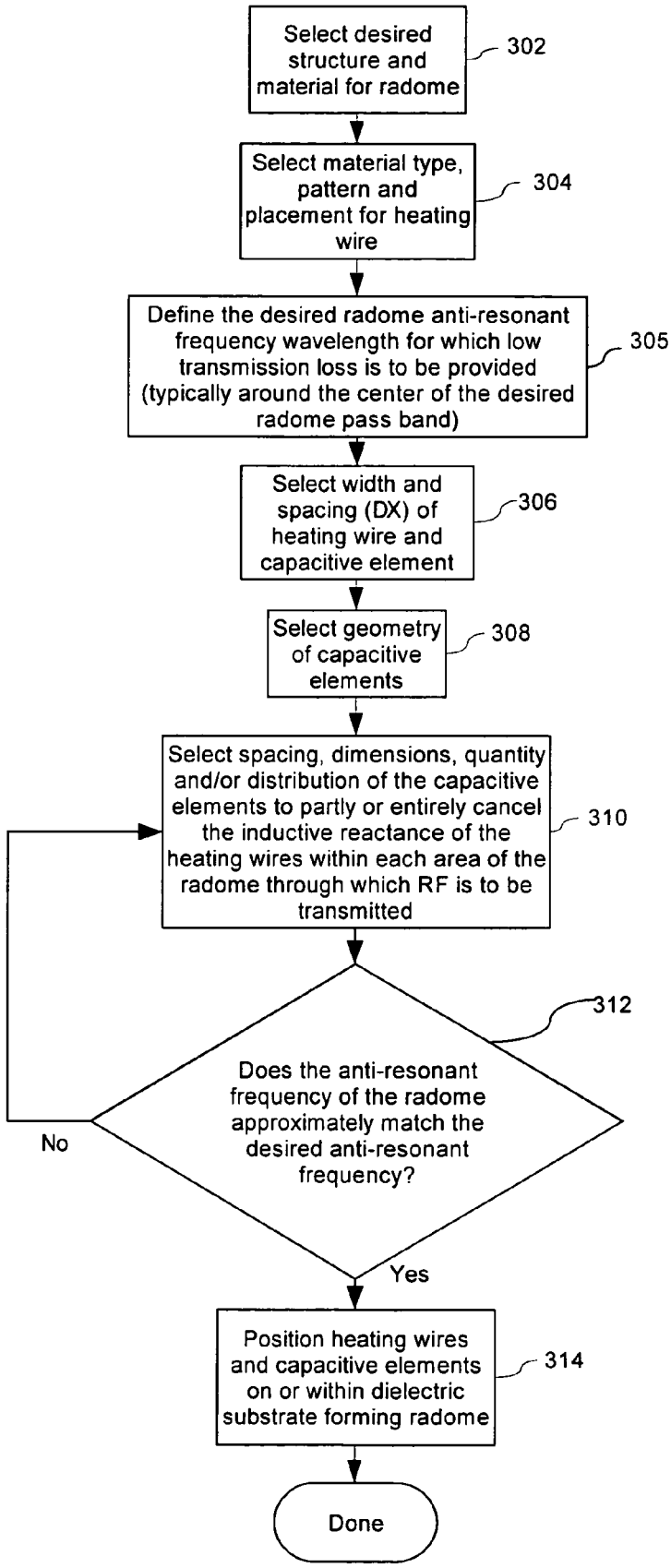
FIG. 3 is a flow chart that is useful for understanding a method for forming a radome in accordance with the inventive arrangements.

Referring now to FIG. 3, it can be observed that the invention also concerns a method for improving RF performance of a radome that includes a plurality of conductive heating wires. The method can begin with selection of certain design parameters. In step 302 a desired structure and material for the radome 102 can be selected. For example, the dielectric substrate can be selected to include one or more layers of a polyimide or polyester material disposed over a reinforced thermoset material.

The method can also include in step 304 a selection of a material type, pattern and position for the heating wire 114. The heating wire can be arranged in continuous lines as shown and can follow any desired pattern. Further, the heating wires can be designed so that they are electrically connected to a ground of a vehicle on which the radome is mounted to improve lighting protection and anti-static protection of the radome. Suitable resistance wire materials are well known in the art. For example, it is well known that Nickel Chrome (NiCr) alloys can be used for this purpose. Other types of heating alloys that can be used for heating wires 114 include those formed from mixtures of Iron, Chromium and Aluminium (FeCrAl). Still, those skilled in the art will appreciate that the invention is not limited to any particular alloy or mixture of metals.

In step 305, a radome designer can select a desired radome anti-resonant frequency wavelength for which low loss transmission is to be provided through the radome. Typically, the radome anti-resonant frequency will be in approximately the center of the radome pass band. However, the invention is not limited in this regard. All that is necessary is that the anti-resonant frequency be positioned relative to the radome pass band so as to have the desired effect of providing a desired low transmission loss through the radome over the range of pass band frequencies.

Once the foregoing design parameters have been selected, the method can continue in step 306 by selecting the width of the heating wire and capacitive elements. Those skilled in the art will appreciate that the width of the heating wires will influence an inductive reactance associated with the heating wire per unit area of the radome surface. Step 306 can also include selecting the spacing or distance DX between heating wires as shown in FIG. 2 The distance between heating wires and capacitive elements can be selected to be DX/2 as shown in FIG. 2. Still, the invention is not limited in this regard, and other spacing selections are also possible. Note that overlapping of capacitive elements is preferably avoided.

In step 308, a geometry of the capacitive elements can be selected. Further, in step 310, the spacing, dimensions, quantity and/or distribution of the capacitive elements 116 can be selected to partly or entirely cancel the inductive reactance of the heating wires within each area of the radome through which RF is to be transmitted. This selection process can be conducted by means of a mathematical analysis, computer modeling techniques, by experimental methods, or by using a combination of these techniques.

In step 312, an analysis and experimental verification can be performed to determine if the radome anti-resonant frequency approximately matches the anti-resonant frequency for the radome which is achieved using the element geometry, dimensions, and spacing selected in the preceding steps. If so, the design process is complete and the process can continue with step 314. However, if the resulting anti-resonant frequency does not approximate the desired anti-resonant frequency, then the process can return to step 310. In step 310, the selection of capacitive element geometry, spacing, dimensions, quantity, and/or distribution can be selectively varied with respect to the previous values in an iterative process until satisfactory results are achieved in step 312.

In step 314, two or more capacitive elements can be interspersed among the heating wires on the substrate of the dielectric. According to one embodiment, the capacitive elements can be positioned between adjacent ones of the heating wires as shown in FIGS. 1 and 2. Further, if the capacitive elements are dipoles, then an elongated length of the dipoles can be aligned with an elongated length of the heating wires. Aligning the ends of the capacitive elements in this way, with two or more elongated dipole elements arranged in a column, can provide a compact arrangement for the periodic surface. For convenience of manufacture, the wires and/or the capacitive elements can be printed on a dielectric substrate forming a part of the radome.

Referring again to FIG. 2, an example is provided that is useful for understanding the invention. Initially, heating wire material and thickness must be specified given design requirements such as heating, frequency of operation, power handling and RF loss requirements. For instance, at frequencies near 3 GHz a heating wire thickness of 40 mils may be acceptable; however, at 20 GHz, a thickness of 5 mils may be required due to RF loss requirements. Once the heating wire geometry is chosen, a printed board with heating wires and detuned elements must be analyzed with an appropriate simulation tool, and this board must be measured so as to quantify the inductive reactance and the amount of capacitance needed to allow frequencies of orthogonal polarizations to go through the heating wire board. For instance, a board with only continuous lines can be measured as well as a board with only detuned printed dipoles. In addition, a board with both continuous wires and printed dipoles can be measured. Once these experiments are performed, a design and development process can be established so as to achieve the correct reactance cancellation.

Heater wires suitable for use with the present invention are commercially available from a variety of sources such as Minco Products, Inc. of Minneapolis, Minn. 55432 (http://www.minco.com/products/heaters.aspx). The present invention increases dramatically the number of practical applications for the heating wire technology already in place. Etched element heaters can be made of nickel or nickel-iron. Thermal-clear heaters use copper wire, nickel wire or nickel-iron wire. Heaters often found in catalogs are specified by resistance, not voltage. When designing the heater one must consider total wattage and watt density in watts per centimeter squared for the application at hand. The watt density determines the maximum applied voltage. Maximum watt density depends on the insulation type, mounting method and operating temperature. Thermofoil heater is a term used to describe this type of heater. The dielectric strength of the insulating material is also important (where the wires are embedded). Kapton, silicon rubber, mica insulation, polyimide and optical grade polyester are used for such materials. The wire thickness is specified by AWG (American Wire Gauge). For instance AWG can be 30, 22 or 18. Typical wire diameters can be 1 mil, 5 mils, 16 mils or other value of this order of magnitude. Temperature controllers are typically used with heating wire boards to regulate the needed applied voltage.

Using the methodology described in FIG. 3, the following dimensions were selected for the radome in FIG. 2:

L=185 mils=4.7 mm
S=19 mils=0.4826 mm
DX=500 mils=12.7 mm
DZ=L+S=204 mils=5.18 mm
W=10 mils=0.254 mm The capacitive elements selected were dipole elements, which were spaced by DX=0.5" and with a defined thickness of 10 mils. The dipole length selected was 4.7 mm and the separation or spacing between a termination or end of each dipole was 0.4826 mm. Continuous heating wires 114 were assumed to be positioned in the same plane as the dipole elements at a distance of DX/2 from the dipoles. Arrays are typically printed on a polyimide or polyester film and then bonded to strong low loss materials such as Cyanate Ester Quartz. Accordingly, for the purposes of the present example, it was assumed that the array of capacitive elements was placed above a Cyanate Ester Quartz layer having a thickness of about 30 mils. The array of capacitive elements was printed on a layer of Kapton® polyimide film, which is commercially available from Sheldahl Technical Materials of Northfield, Minn. The polyimide film layer was placed on top of the Cyanate Ester Quartz layer.

Figure 4:
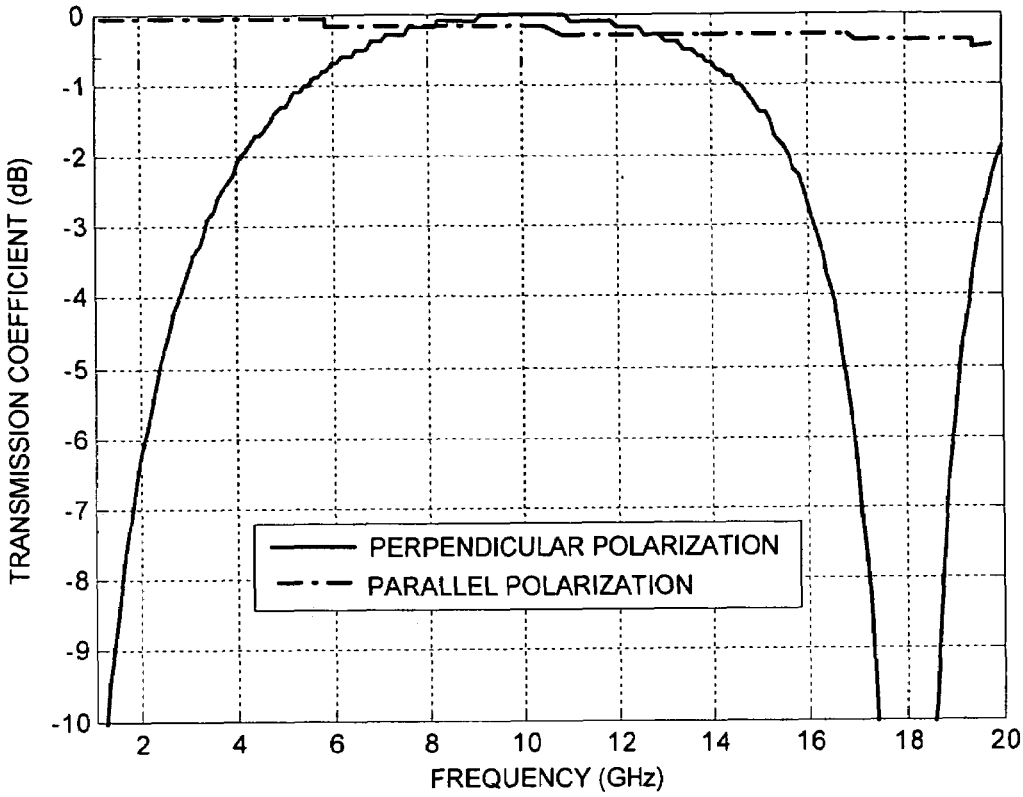
FIG. 4 is computer generated plot that shows a theoretical performance of a radome utilizing the inventive arrangements.

Referring now to FIG. 4, there is shown a computer generated plot for a simulated radome having the foregoing parameters. The plot, performed for angle $\alpha=0°$, $\eta=0°$, shows power loss versus frequency for signals transitioning the radome in two separate polarizations (perpendicular and parallel). The polarization orthogonal to the heating wires is always transmitted through the radome with a relatively low loss as determined by the wire width. However, it can be observed in FIG. 4 that the radome exhibits very low loss for transmissions having perpendicular and parallel polarizations in the region between 8 GHz to 12 GHz.

Figure 5:
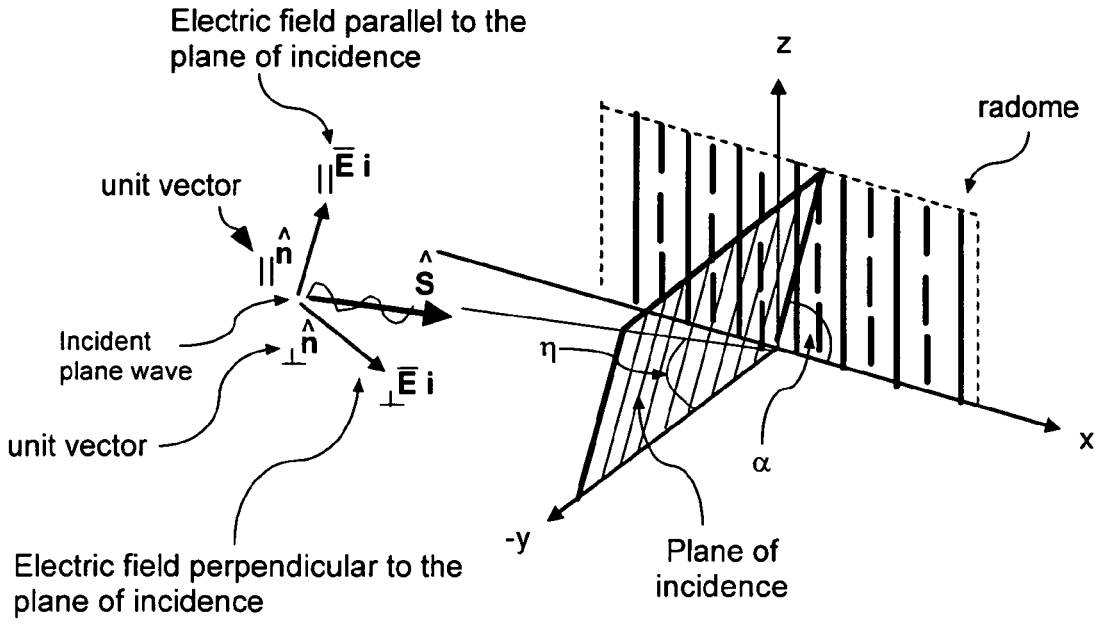
FIG. 5 shows a coordinate system that is useful for understanding the modeled performance characteristics of the invention.

The following angles of incidence were also computed: ($\alpha=90°$, $\eta=(0, 40, 60°)$) and ($\alpha=0°$, $\eta=(0, 40, 60°)$), and showed good performance for a wide range of angles of incidence. This is a desirable feature for a radome design in general. The coordinate system used to define the foregoing angles is shown in FIG. 5. As shown in FIG. 5, $\alpha$ is the angle between a plane of incidence and the x axis, whereas $\eta$ is the angle between the angle of incidence and the y axis.

It may be observed from FIG. 4 that the arrangement of capacitive elements produces an operating band in the vicinity of 10.5 GHZ that provides low transmission loss for both polarizations. There are trapped grating lobes beginning at 13.1 GHz and bistatic grating lobes beginning at 14.3 GHz. These grating lobes are located at frequencies higher with respect to the frequency of operation.

From the foregoing, it can be observed that a radome can be provided that offers the benefits of heating wires, while passing desired signals without a polarizing or attenuating effect within a predetermined frequency band of interest. Those skilled in the art will appreciate that similar results can be obtained for different frequency bands by changing the design parameters for the capacitive and heating wire elements. The design methodology disclosed in FIG. 3 shall now be described in further detail with respect to the example discussed above with respect to FIG. 2.

Prior to discussing the detailed design calculations, it may be useful to discuss the equations that will be used. Calculation of the impedance Z from the reflection coefficient Γ is performed with the following equation:

$$Z = \frac{1+\Gamma}{1-\Gamma} Z_0$$

where $Z_0$ is the impedance of free space. Impedance is a complex electrical quantity that can be expressed as follows:

$$Z=R+jX\Omega$$

where the real part of the impedance is the resistance R in ohms, and the imaginary part of the impedance is the reactance X in ohms. The reactance can be inductive (positive) or capacitive (negative), that is if X>0, then:

$$Z=R+j|X_L|\Omega$$

if X<0, then:

$$Z=R-j|X_C|\Omega$$

Using equations:

$$X_L = \omega L$$

$$X_c = \frac{1}{\omega C}$$

Inductance and capacitances can be calculated as follows:

$$L = \frac{X_L}{\omega} \text{ henries} \quad C = \frac{1}{\omega X_C} \text{ farads}$$

Where ω=2πf is the angular frequency

Typical Circuit Values for 10 GHz at Normal Incidence

The parallel polarization for the three cases studied exhibits a resistance of 321 ohms and a reactance of −105.7 ohms, that corresponds to a capacitance C=0.15 pF. The three cases studied include a radome with infinitely long heating wires only, a radome with capacitive elements only (finite wires), and a radome with a mixture of both heating wires and capacitive elements (complete radome). The orthogonal polarization for the infinitely long wires (continuous) exhibit a resistance R=321 ohms, and a reactance is 105.7 ohms, corresponding to an inductance L=1683 pH. The orthogonal polarization for the finite wires exhibit a resistance of 321 ohms and a reactance of −148.39 ohms that corresponds to a capacitance C=0.107 pF. The mixture of finite and infinite wires exhibits a resistance of 321 ohms and a reactance of 4.37 ohms, that corresponds to an inductance of 69.48 pH. By disposing the finite wires or capacitive elements interspersed with the heating wire lattice as show in FIG. 2, the reactance of the infinitely long wires is reduced from 105.7 ohms to 4.37 ohms. This creates a null in the reflection coefficient that facilitates very low loss transmission of energy.

Figure 6A:
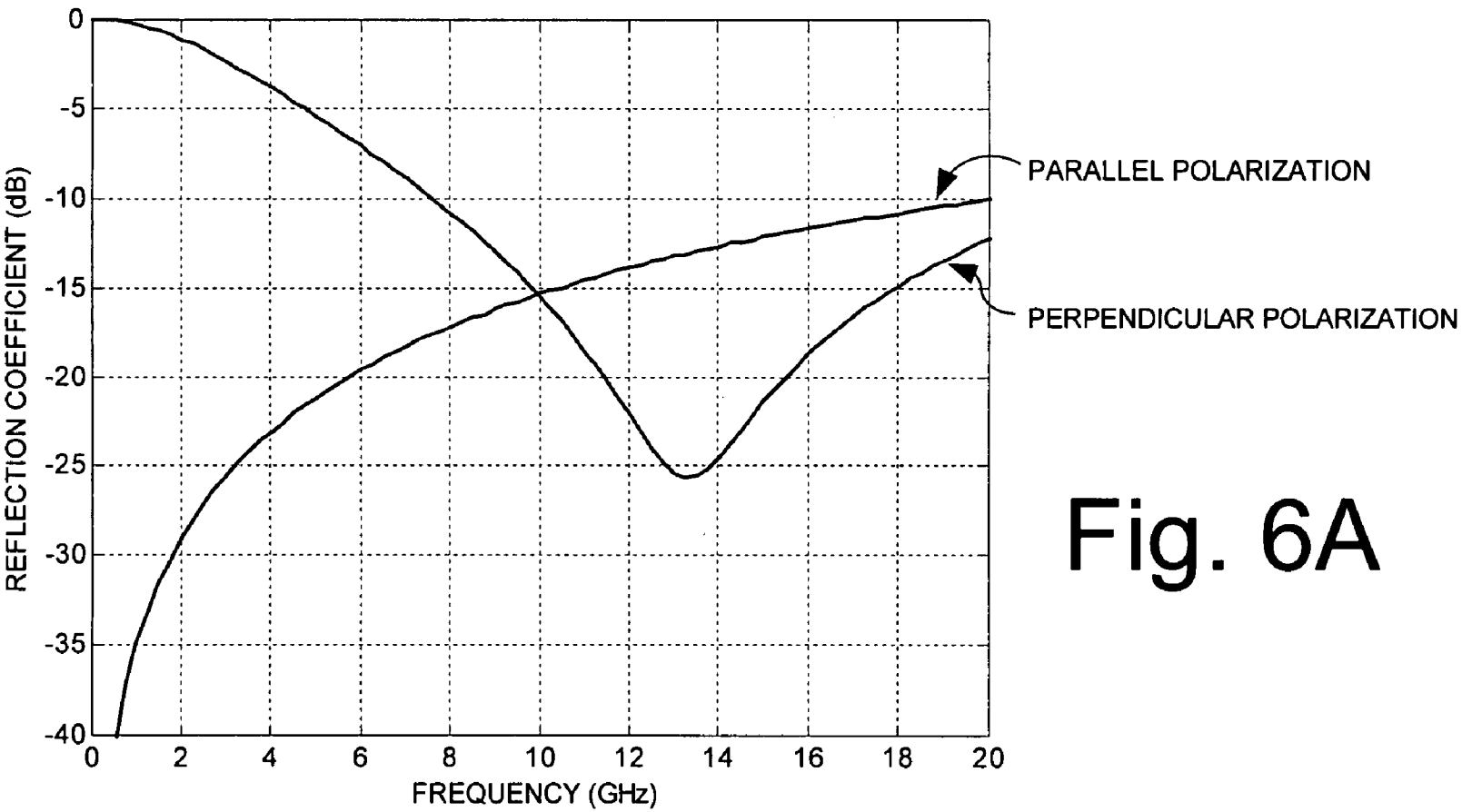
FIG. 6*a* shows a plot of reflection coefficient versus frequency for a plurality of infinitely long wires.

Referring now to FIG. 6*a*, there is shown a plot of reflection coefficient versus frequency for a plurality of infinitely long wires. It can be observed in FIG. 6*a* that the infinitely long wires have a resonant frequency at $f_0$=0 GHz. For the purpose of understanding FIG. 6*a*, there is shown in FIG. 6*b* the orientation of the reflected electric field perpendicular to the plane of incidence, and the reflected electric field parallel to the plane of incidence, which are respectively designated as follows:

$$_{\perp}E_r, {}_{\parallel}E_r$$

Figure 6B:
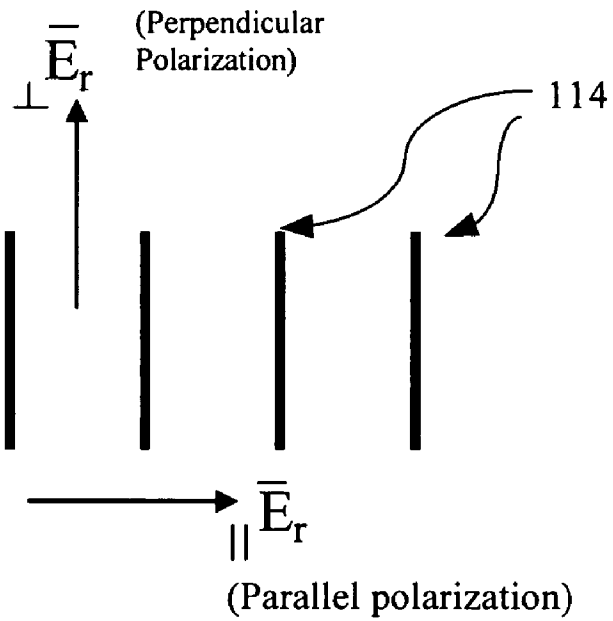
FIG. 6*b* shows the orientation of the electric field orthogonal polarization components for a plurality of parallel wires of infinite length.

Similarly, the perpendicular reflected electric field, and parallel reflected electric field are designated as perpendicular polarization and parallel polarization, and their direction is also shown in FIG. 6*b*. Referring again to FIG. 6*a*, it can be observed that the perpendicular polarization for the transmitted electric field is not being transmitted since this polarization is parallel to the continuous wires in FIG. 6*b*. This is the radome problem which this invention solves. Conversely, it can be observed in FIG. 6*a* that the parallel polarization of the transmitted electric field is being transmitted since that polarization is perpendicular to the continuous wires.

Figure 7B:
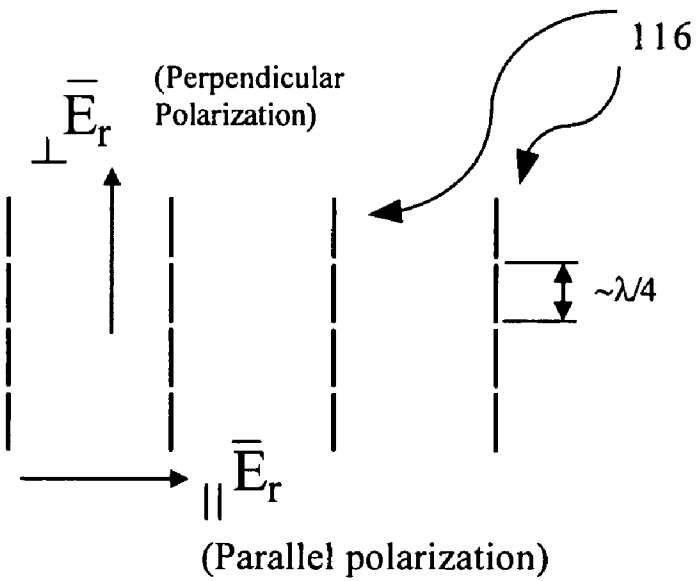
FIG. 7*b* shows the orientation of the electric field orthogonal polarization components for a plurality of parallel wires of finite length.
Figure 7A:
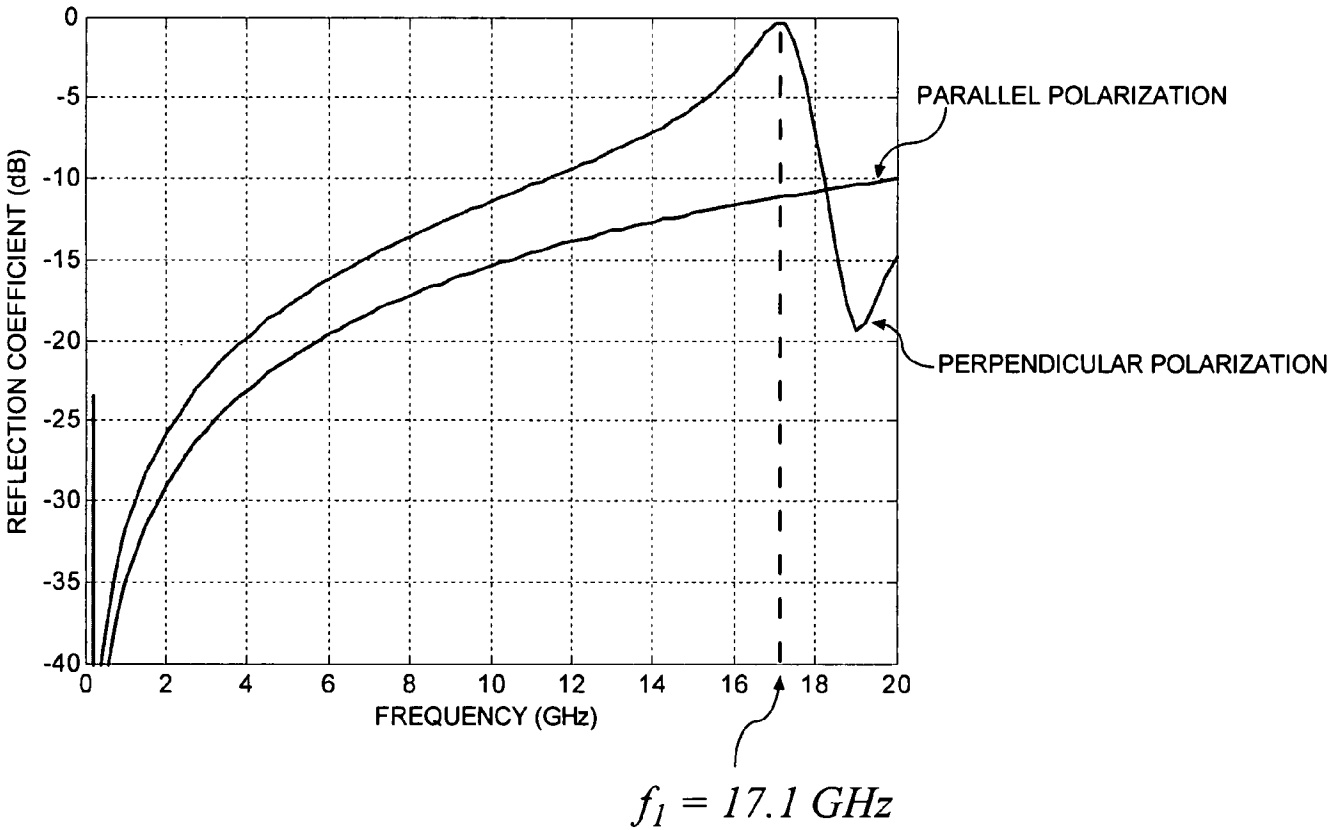
FIG. 7*a* shows a plot of reflection coefficient versus frequency for a plurality of finite wires.

FIG. 7*a* shows a plot of reflection coefficient versus frequency for a plurality of finite wires. For the purpose of better understanding the plot in FIG. 7*a*, there is shown in FIG. 7*b* the orientation of the reflected electric field orthogonal polarizations relative to a plurality of parallel wires of finite length. In FIG. 7*a*, it can be observed that the finite length wires or dipole elements "resonate" at a frequency of $f_1$=17.1 GHz.

Figure 8A:
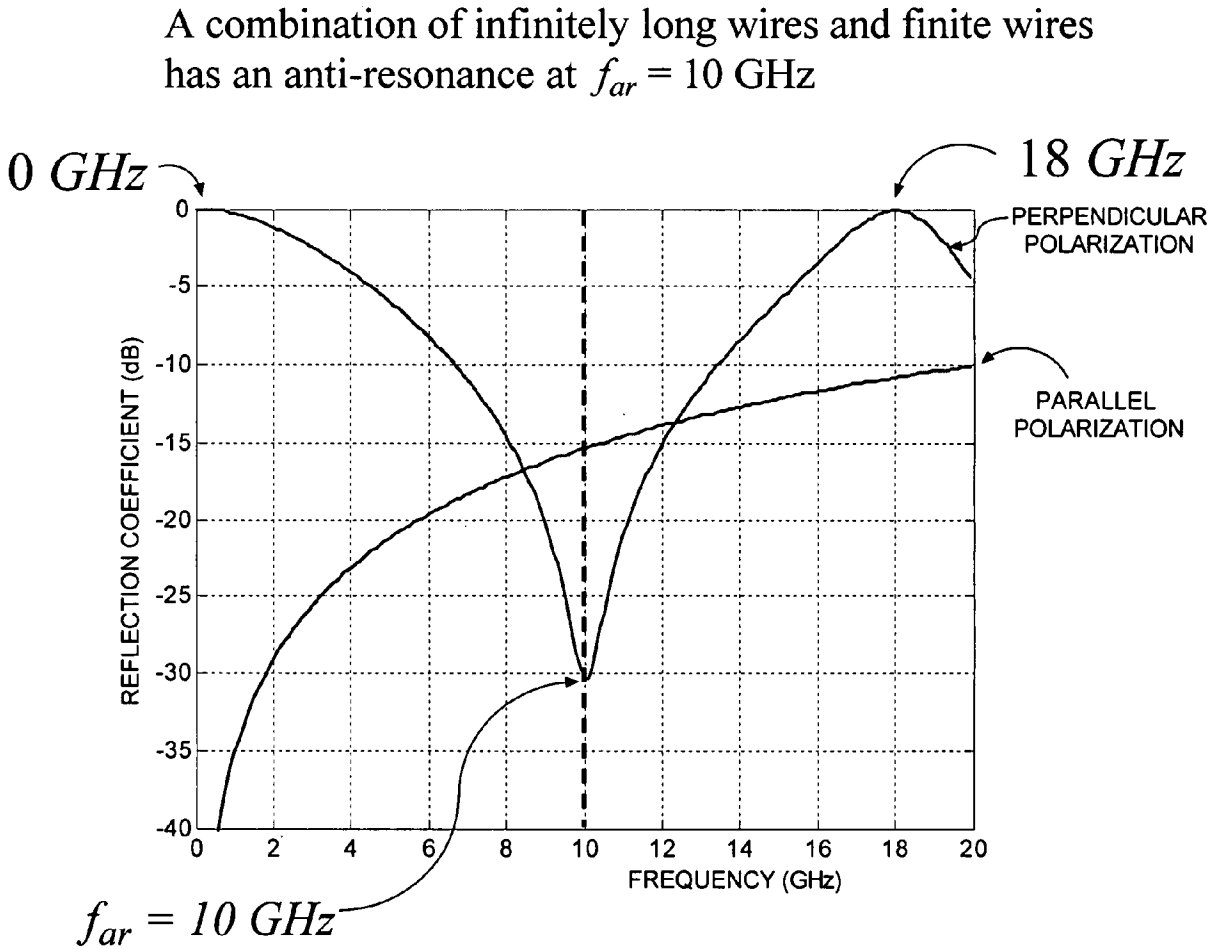
FIG. 8*a* shows a plot of reflection coefficient versus frequency for a combination of finite wires and infinite wires.
Figure 8B:
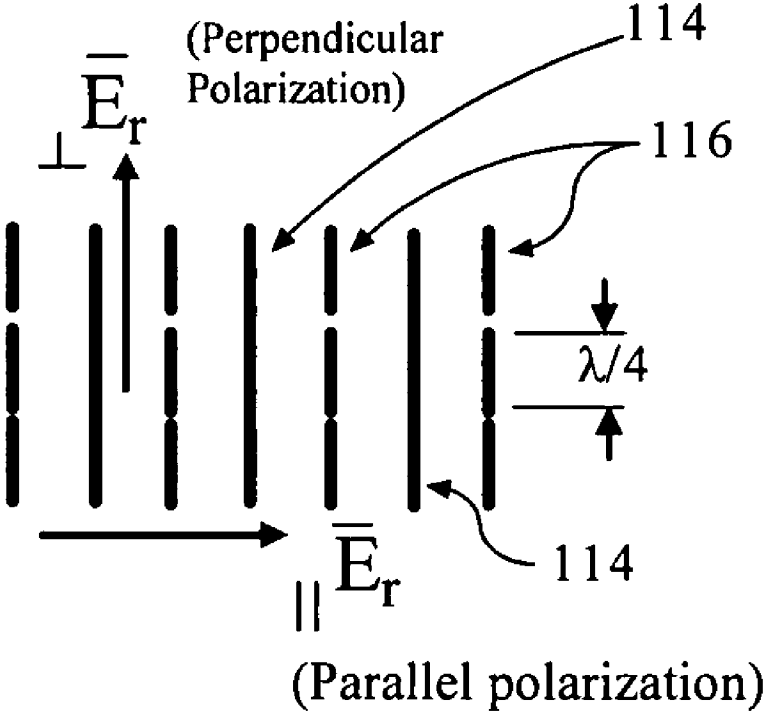
FIG. 8*b* shows the orientation of the electric field orthogonal polarization components for a plurality of parallel wires of finite length mixed with a plurality of infinitely long wires.

FIG. 8*a* shows a plot of reflection coefficient versus frequency for a combination of the finite wires or capacitive elements and infinite wires modeled in FIGS. 6*a* and 7*a*. For the purpose of better understanding the plot in FIG. 8*a*, there is shown in FIG. 8*b* the orientation of the reflected electric field orthogonal polarizations relative to the combined plurality of parallel infinite wires and parallel wires of finite length. In FIG. 8*a* it can be observed that at $f_{ar}$=10 GHz, the reflection coefficient is −30.4 dB, meaning that almost all of the energy associated with the electric field perpendicular to the plane of incidence is transmitted through the radome. Note that the electric field parallel to the plane of incidence in this example is already transmitted through the heating wires, with a low loss determined by the width of the wires and the loss tangent and thickness of the dielectric substrates used, since this polarization is aligned in a direction perpendicular to the long heating wires and capacitive elements. Therefore; it should be understood that in this example, the only polarization addressed by the invention is perpendicular to the plane of incidence which is parallel to the heating wires. The electric field polarized parallel to the plane of incidence and perpendicular to the heating wires passes through the radome and does not need to be corrected. However, note that the thickness of the wires used and the electric loss tangent of the dielectric materials used cause losses for both the perpendicular and the parallel components of the electric field.

The physics of operation is summarized as follows. When only infinitely long wires are used, the reflection coefficient has a maximum at f0=0 Hz. When finite wires are used, the reflection coefficient has a maximum at f1, which in the example provided is f1=17.1 GHz, that corresponds to a wire size of about a quarter of a wavelength at f1. When infinitely long and finite wires are mixed together, an antiresonance occur between f0 and f1, which in this case is between 0 Hz and 17.1 GHz, and which occurs at exactly 10 GHz. Because there is a reflection coefficient null at 10 GHz, the transmission loss is the lowest at this frequency and most of the energy is transmitted

We claim:

1. A method for improving RF performance of a radome that includes a plurality of conductive heating wires disposed in or on a dielectric substrate, comprising:

determining an inductive reactance of said heating wires;

disposing a plurality of capacitive elements in or on said dielectric substrate and interspersed among said heating wires to provide a capacitive reactance to at least partially cancel said inductive reactance, said disposing comprising selecting said capacitive elements to include a lattice of electrically conductive elements, and arranging said electrically conductive elements be electrically isolated from said heating wires and each other; and positioning at least two of said plurality of capacitive elements between two adjacent wires of said plurality of conductive heating wires.

2. The method according to claim 1, further comprising selecting said electrically conductive elements to be dipoles.

3. The method according to claim 2, further comprising aligning an elongated length of said dipoles with an elongated length of said conductive heating wires.

4. The method according to claim 1, further comprising selecting said heating wires and said plurality of capacitive elements in combination to define an anti-resonant frequency for said radome, said anti-resonant frequency comprising a frequency of maximum cancellation of said inductive reactance.

5. The method according to claim 4, further comprising selecting said anti-resonant frequency to be within said low loss pass-band.

6. The method according to claim 1, further comprising selecting said heating wires and said plurality of capacitive elements to provide a low loss pass-band for said radome at a desired frequency band that passes signals with all polarizations through said radome with low loss within said desired frequency band.

7. The method according to claim 1, further comprising printing at least one of said conductive heating wires and said capacitive elements on a dielectric substrate.

8. The method according to claim 7 further comprising selecting said dielectric substrate to include one or more layers formed from at least one material selected from the group consisting of a polyester film, a polyimide film, and a reinforced thermoset material.

9. The method according to claim 1, further comprising connecting said conductive heating wires to a ground of an antenna system associated with said radome.

10. The method according to claim 1, further comprising heating said radome by passing an electric current through at least one of said conductive heating wires.

11. The method according to claim 1, wherein said lattice of electrically conductive elements is selected to be a periodic lattice of electrically conductive elements.

12. A radome, comprising:

a dielectric substrate;

a plurality of conductive heating wires disposed in or on said dielectric substrate, said conductive heating wires having an inductive reactance; and a plurality of capacitive elements interspersed among said heating wires, said capacitive elements including a lattice of electrically conductive elements in or on said substrate, and said electrically conductive elements being isolated from said heating wires and each other;

wherein said plurality of capacitive elements at least partially cancel the inductive reactance of said conductive heating wires, and at least two of said plurality of capacitive elements are positioned between two adjacent wires of said plurality of conductive heating wires.

13. The radome according to claim 12, wherein said plurality of conductive heating wires and said plurality of capacitive elements in combination at least partially determine an anti-resonant frequency for said radome, said anti-resonant frequency comprising a frequency of maximum cancellation of said inductive reactance.

14. The method according to claim 12, wherein said radome comprises a low loss pass-band for signals transitioning through said radome at all polarizations, a frequency range of said pass-band at least partially determined by an anti-resonant frequency of said radome.

15. The method according to claim 14, wherein said anti-resonant frequency is a frequency of maximum cancellation of said inductive reactance.

16. The radome according to claim 12, wherein said electrically conductive elements are dipoles.

17. The radome according to claim 16, wherein an elongated length of a plurality of said dipoles is aligned with an elongated length of said conductive heating wires.

18. The radome according to claim 12, wherein said conductive heating wires and said capacitive elements are printed on said dielectric substrate.

19. The radome according to claim 12, wherein said dielectric substrate is formed of at least one material selected from the group consisting of a polyester film, a polyimide film, and a reinforced thermoset material.

20. The radome according to claim 12, wherein said conductive heating wires are connected to a ground of an antenna system associated with said radome.

21. The radome according to claim 12, wherein said conductive heating wires form part of an electric circuit that heats said radome when current is applied to the heating wires.

22. The method according to claim 12, wherein said lattice of electrically conductive elements is a periodic lattice of electrically conductive elements.

23. A communications system, comprising:

an antenna system comprising an array of antenna elements disposed on an antenna substrate; and a radome covering or enclosing at least a portion of said antenna system, said radome comprising:

a dielectric substrate, a plurality of conductive heating wires disposed in or on said dielectric substrate, and a plurality of dipole elements disposed on or in said dielectric substrate and interspersed among said heating wires, said dipole elements being are arranged in a lattice and electrically isolated from each other and said heating wires, wherein said dipole elements at least partially cancel an inductive reactance of said conductive heating wires, and at least two of said plurality of dipole elements are positioned between two adjacent wires of said plurality of conductive heating wires.

* * * * *